US007219849B1

(12) United States Patent
Hedger

(10) Patent No.: US 7,219,849 B1
(45) Date of Patent: May 22, 2007

(54) LIQUID IMPINGEMENT NOZZLE WITH PAIRED OPENINGS

(75) Inventor: Tom Hedger, Renton, WA (US)

(73) Assignee: Graves Spray Supply, Inc., Clearwater, FL (US)

( * ) Notice: Subject to any disclaimer, the term of this patent is extended or adjusted under 35 U.S.C. 154(b) by 0 days.

(21) Appl. No.: 11/300,130

(22) Filed: Dec. 13, 2005

(51) Int. Cl.
*B05B 1/26* (2006.01)

(52) U.S. Cl. ..... 239/543; 239/544; 239/601

(58) Field of Classification Search ..... 239/543, 239/544, 601, 333, 337, 418, 426, 433, 434, 239/548, 552, 567
See application file for complete search history.

(56) References Cited

U.S. PATENT DOCUMENTS

| | | | | | |
|---|---|---|---|---|---|
| 2,235,258 | A | * | 3/1941 | Jones | 239/544 |
| 2,249,205 | A | | 7/1941 | Hansen | |
| 2,335,116 | A | | 11/1943 | Hansen | |
| 2,551,538 | A | | 5/1951 | Hensel | |
| 2,941,696 | A | | 6/1960 | Homm | |
| 3,033,472 | A | | 5/1962 | Shelton et al. | |
| 3,045,925 | A | | 7/1962 | Gianqualano | |
| 3,125,298 | A | * | 3/1964 | Iwata | 239/543 |
| 3,542,296 | A | | 11/1970 | Bradley | |
| 3,986,672 | A | | 10/1976 | Smith et al. | |
| RE30,486 | E | | 1/1981 | Beck | |
| 4,783,008 | A | * | 11/1988 | Ikeuchi et al. | 239/421 |
| 4,824,017 | A | | 4/1989 | Mansfield | |
| 4,854,504 | A | | 8/1989 | Hedger, Jr. et al. | |
| 4,925,104 | A | | 5/1990 | Smith | |
| 4,948,048 | A | | 8/1990 | Smith | |
| 5,067,515 | A | | 11/1991 | Smith | |
| 5,085,370 | A | | 2/1992 | Smith | |
| 5,088,649 | A | * | 2/1992 | Hanson et al. | 239/329 |
| 5,358,179 | A | * | 10/1994 | Lund et al. | 239/333 |
| 5,516,045 | A | | 5/1996 | Baudin | |
| 5,540,200 | A | | 7/1996 | Naitoh et al. | |
| 5,779,156 | A | * | 7/1998 | Crampton | 239/337 |
| 5,890,661 | A | * | 4/1999 | Crampton et al. | 239/544 |
| 6,042,025 | A | * | 3/2000 | Crampton et al. | 239/337 |
| 6,113,013 | A | | 9/2000 | Sand | |
| 6,322,008 | B1 | | 11/2001 | Aker et al. | |
| 6,824,077 | B2 | * | 11/2004 | De Laforcade | 239/333 |
| 2004/0026528 | A1 | * | 2/2004 | Jenkins | 239/11 |
| 2005/0087631 | A1 | * | 4/2005 | Ursic | 239/548 |

* cited by examiner

*Primary Examiner*—Kevin Shaver
*Assistant Examiner*—Darren Gorman
(74) *Attorney, Agent, or Firm*—Larson & Larson, PA; Frank Liebenow

(57) ABSTRACT

An improved liquid impingement nozzle having two openings along an axis, spaced apart and angled towards each other. A non-atomized liquid stream of the same liquid is directed through each opening by a pressurized source. The two streams meet at an apex distal from the front of the nozzle to create a flat triangular pattern of liquid. The inner shape of the nozzle is substantially conical reducing turbulence and dead zones within the nozzle, thereby reducing build-up and clogging.

26 Claims, 4 Drawing Sheets

LIQUID IMPINGEMENT NOZZLE WITH PAIRED OPENINGS

BACKGROUND OF THE INVENTION

1. Field of the Invention

This invention relates to liquid spray nozzles and more particularly to a spray nozzle having openings angled towards each other to form a triangular spray pattern and a mixing chamber shaped to reduce turbulence and clogging.

2. Description of the Related Art

Spray nozzles for generating streams of liquid are well known as seen from U.S. Pat. No 6,322,008 to Mark Aker, et al, which is hereby incorporated by reference. This patent describes a nozzle having at least two openings on its face, spaced apart from one another and angled towards each other such that two individual streams cross each other at a point distant from the face of the nozzle. A non-atomized, pressurized stream passes through each opening and meets at an intersection point, forming a flat, triangular pattern. The nozzle is useful in spraying polyester gelcoat applications and reduces emissions of volatile organic compounds.

Often, the materials sprayed using this nozzle or similar nozzles are very viscous or harden quickly. For example, boat hulls are often formed by spraying resins over a mold. In some applications, fillers are added to the resin such as calcium sulfate, calcium carbonate and aluminum trihydrate to improve fire retardency. These fillers further thicken the resins. The viscosity of these liquids and their fast hardening times often cause problems with the nozzle such as clogging. Other than the general problem of clogging of the nozzle openings, the flow of the material within the nozzle causes problems. Turbulence within the nozzle creates dead-spots where the material being sprayed may sit without passing through the nozzle. After time, that material may harden, reducing the area within the nozzle, leading to different dead spots. Eventually, more material may harden within the nozzle, leading to reduced flow. Finally, part of the hardened material may break away and clog the openings in the nozzle or may exit the nozzle and attach itself to the target object. As this build-up occurs, the spraying operation must be stopped, the nozzle removed and cleaned or replaced, and the spraying operation restarted. This stop/restart operation reduces the efficiency of the application and may affect the overall quality of the spray by creating runs or uneven applications.

What is needed is a nozzle that will provide all the advantages of the prior nozzles while reducing accumulation within the nozzle, hence reducing clogging and the need for replacing or cleaning the nozzle during the spray operation.

SUMMARY OF THE INVENTION

In one embodiment, a nozzle for spraying a liquid is disclosed including two openings in the face of the nozzle adapted for generating a non-atomized liquid stream of the same liquid from each of the two openings, the two openings having a first opening and a second opening, the first opening spaced apart from the second opening and the first opening and the second opening angled along a common axis towards each other at an angle of from 1° and 89°. The nozzle is adapted to receive the non-atomized liquid stream of the same liquid directed through the two openings by a pressurized source. The inside cavity of the nozzle is substantially conical in shape. The two openings are configured so the non-atomized liquid stream of the same liquid from the first opening meets the non-atomized liquid stream of the same liquid from the second opening at an apex some distance from the common axis without interference from any solid object interposed between the common axis and the apex, the meeting of the non-atomized liquid streams of the same liquid creates a triangular liquid spray pattern.

In another embodiment, a nozzle for spraying a liquid is disclosed including two openings passing through a face of the nozzle, the two openings include a first opening and a second opening. The first opening is spaced apart from the second opening by from 0.010 to 2.0 inches and the first opening and the second opening are angled along a common axis towards each other at an angle of from 10 and 89°. The nozzle is adapted for generating a non-atomized liquid stream of the same liquid, the non-atomized liquid stream of the same liquid is directed through the two openings by a pressurized source. The nozzle has an inside cavity that is substantially conical in shape. The two openings are configured so the non-atomized liquid stream of the same liquid from the first opening meets the non-atomized liquid stream of the same liquid from the second opening at an apex distal from the common axis without interference from any solid object interposed between the common axis and the apex, the meeting of the non-atomized liquid streams of the same liquid creates a triangular liquid spray pattern.

In another embodiment, a nozzle for spraying a liquid is disclosed including a device for mounting two circular openings on a fixed support along a common axis, the two circular openings include a first circular opening and a second circular opening. The first circular opening spaced apart from the second circular opening and the first circular opening and the second circular opening angled along the common axis towards each other at an angle of from 10 and 89°. The nozzle is adapted to receive a non-atomized liquid stream of the same liquid directed through each of the two circular openings by a pressurized source. The nozzle has an inside cavity that is substantially conical in shape. The two circular openings are configured so the non-atomized liquid stream of the same liquid from the first circular opening meets the non-atomized liquid stream of the same liquid from the second circular opening at an apex at a distance from the common axis without interference from any solid object interposed between the common axis and the apex, the meeting of the non-atomized liquid streams of the same liquid creates a triangular liquid spray pattern.

In another embodiment, an improved nozzle for spraying a liquid is disclosed including at least one pair of openings in a face of the nozzle adapted for generating an uninterrupted non-atomized solid liquid stream of the same liquid from the at least one pair of openings directed towards each other, each opening from each pair of openings being spaced apart from each other and angled along a common axis towards each other at an angle of from 1° and 89°. The nozzle is adapted to receive the uninterrupted non-atomized solid liquid stream of the same liquid directed through each opening by a pressurized source and the openings are configured so the uninterrupted non-atomized solid liquid stream of the same liquid from each opening meets at a distance from the common axis without interference from any solid object interposed between the common axis and the meeting of the uninterrupted non-atomized solid liquid stream of the same liquid. The meeting of the uninterrupted non-atomized solid liquid stream of the same liquid creates a triangular liquid spray pattern. The improvement comprises a conical shaped cavity within the nozzle behind the face.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
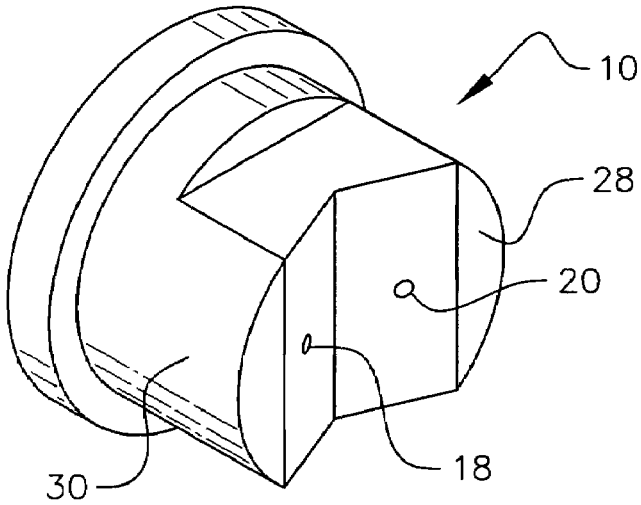
FIG. 1 (PRIOR ART)
FIG. 1 illustrates a front perspective view of a nozzle of the prior art.

Reference will now be made in detail to the presently preferred embodiments of the invention, examples of which are illustrated in the accompanying drawings. Throughout the following detailed description, the same reference numerals refer to the same elements in all figures.

Figure 2:
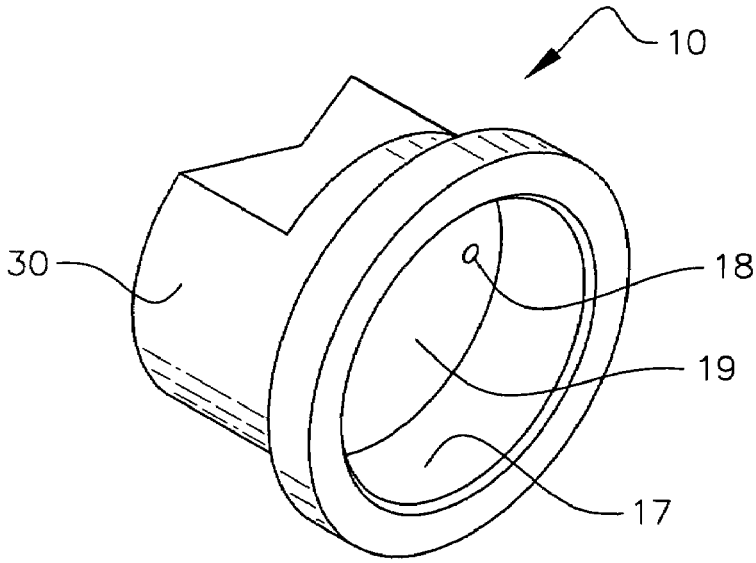
FIG. 2 (PRIOR ART)
FIG. 2 illustrates a rear perspective view of a nozzle of the prior art.

Referring to FIG. 1, a front perspective view of a nozzle of the prior art is shown. The nozzle 10 of the prior art shown in FIG. 1 and FIG. 2 is affixed to a spray gun (not shown) which has a pressurized source (also not shown) such as a pump that directs liquid through the nozzle 10 openings 18 and 20. The openings 18 and 20 are spaced apart at a distance and angled towards each other such that liquid flowing from the first opening 18 meets the liquid flowing from the second opening 20 at an apex some distance from the face of the nozzle. In some embodiments, the liquids flowing from the first opening 18 and from the second opening 20 are the same while in other embodiments, a different liquid flows from the second opening. In some embodiments, more than one pair of openings is deployed (not shown). In some embodiments, the face 28 is flat (not shown) while in some embodiments, the face 28 is shaped or etched. In the prior art, the side surface 30 is generally rounded.

Referring to FIG. 2, a rear perspective view of a nozzle of the prior art is shown. The surface behind the face 19 of the prior art is generally flat and the inside walls 17 of the nozzle 10 are generally cylindrical relating to the outside wall 30 shape. Pressurize liquid enters the cavity formed by the inside walls 17 and the surface behind the face 19 and exits through the openings 18, 20 (opening 20 is not visible in FIG. 2). Because of the shape of the cavity, the flow of liquid creates turbulence within the cavity. The turbulence causes small amounts of the liquid to loop and remain within the cavity for an extended period of time. For many applications, such as liquid polyester resins, polyurethane resins and polyurethane foams, the liquids will harden in as little as 15 seconds. Therefore, these small amounts of liquids caught in the turbulence and tend to harden. The hardened particles attach to the inside surfaces 17, 19 and create additional turbulence or dead spots. Eventually, some of the hardened particles reach the openings 18, 20 and, if small enough, pass through and create an uneven spray or, if large enough, clog one or both openings 18, 20. The shape of the cavity of the prior art is not ideal for a nozzle that delivers a spray of high viscosity liquids. In addition to the hardening and clogging issue, the turbulence also affects the flow in the stream, creating a laminar flow that is less laminar than desired.

Figure 3:
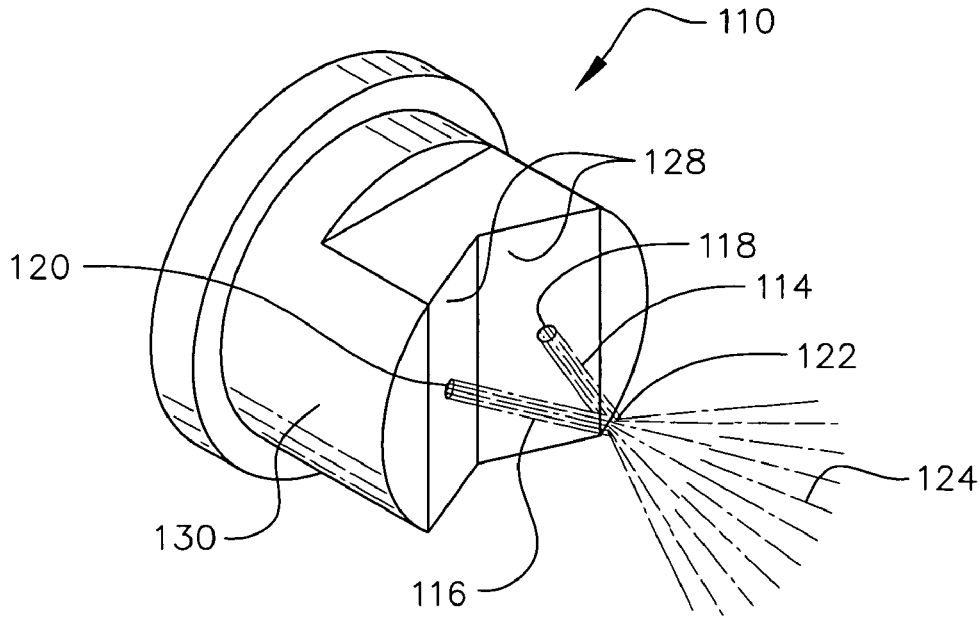
FIG. 3 illustrates a front perspective view of the nozzle and spray pattern of the present invention.
Figure 4:
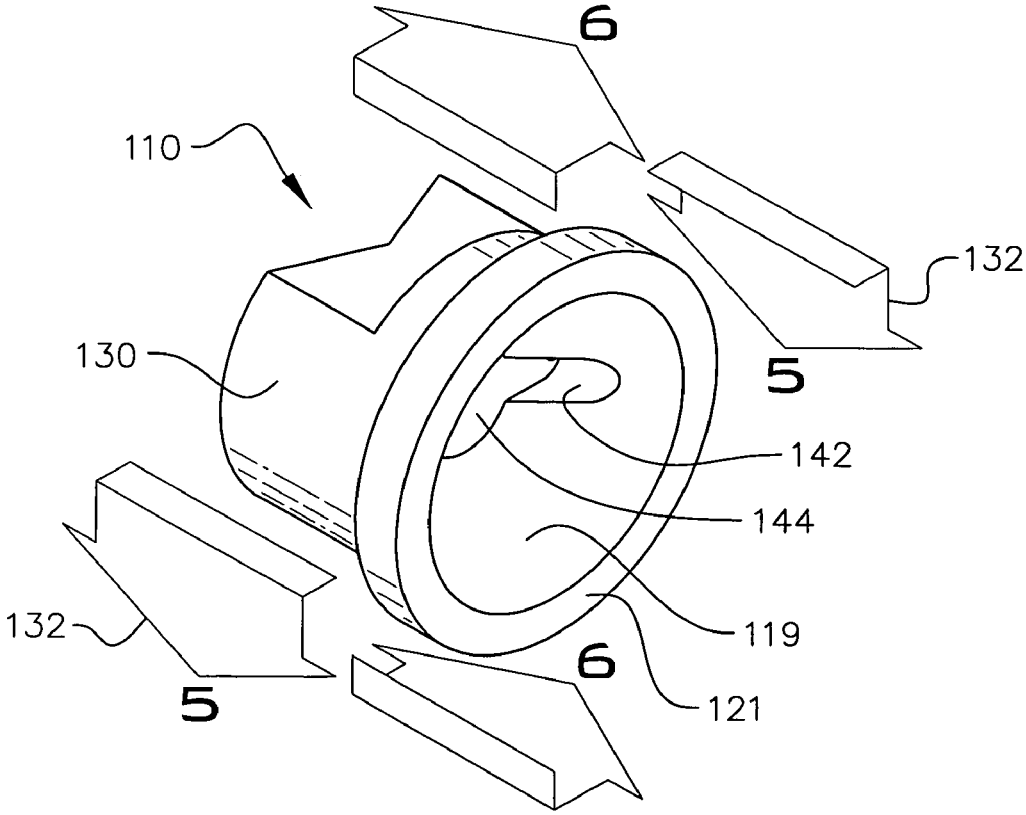
FIG. 4 illustrates a rear perspective view of the nozzle of the present invention.

Referring to FIG. 3, a front perspective view of the nozzle and spray pattern of the present invention is shown. The nozzle 110 of the present invention shown in FIG. 3 and FIG. 4 is affixed to a spray gun (not shown) which has a pressurized source (also not shown) such as a pump that directs liquid through the nozzle 110 openings 118 and 120. The openings 118 and 120 are spaced apart at a distance and angled towards each other such that liquid 114 flowing from the first opening 118 meets the liquid 116 flowing from the second opening 120 at an apex 122 distal from the face 128 of the nozzle. In some embodiments, the liquids flowing from the first opening 118 and from the second opening 120 are the same while in other embodiments, a different liquid flows from the second opening 120. In some embodiments, more than one pair of openings is deployed (not shown). In some embodiments, the face 128 is flat (not shown) while in some embodiments, the face 128 is shaped or etched.

The liquid streams 114, 116 flow from the openings 118, 120 at an angle towards one another such that they meet at an apex 122 and form a triangular spray pattern 124 beyond the apex 122. The angle of the between openings 118, 120 can range anywhere between 1° and 89°. The smaller the degree of angle with respect to the face 128, the closer the two streams meet at the apex 122. It is preferred for use in the spray of resin to have the angle of the openings 118, 120 range between 2° and 55°. In some embodiments, the openings 118, 120 are circular as shown. In other embodiments, the openings 118, 120 are oval or any other shape (not shown). Generally, in non-circular configurations, the opening size can be from 0.00002 to 3.5 square inches. In the preferred embodiment, the openings 118, 120 are circular with a diameter in the range of 0.005 to 0.175 inches. In one embodiment, the distance between the openings can be from 0.01 to 2.0 inches. In agricultural and water nozzles, the angle of the openings 118, 120 is preferred to be between 5° and 75° with a circular opening diameter between 0.01 to 0.2 inches with a distance between openings 118, 120 of between 0.1 and 16 inches. In the preferred embodiment, the side surface 130 is generally rounded.

Referring to FIG. 4, a rear perspective view of the nozzle of the present invention is shown. The inside cavity (surface behind the face of the nozzle 110) is generally conical (cone-shaped) 119. Pressurized liquid enters the inside cavity formed by the cone 119 that is formed between the back edge 121 of the nozzle and the surface 144 behind the face 128. The liquid exits through the openings 118, 120 (openings are not visible in FIG. 4) along axis 132 of the face 128. A conical shaped cavity is defined by the cone-shaped wall 119 and a generally flat surface 144 behind the face 128. Cuts 142 are made into the cone shaped wall 119 allowing the liquid to flow to the openings 118, 120. The cuts 142 are preferably rounded to reduce turbulence and clogging. Because of the cone-shape of the cavity, the liquid flows smoothly through the cavity, reducing turbulence that would otherwise cause small amounts of the liquid to loop and remain within the cavity for an extended period of time, creating the problems highlighted in the discussion of the prior art (FIG. 2). For many applications, such as liquid polyester resins, polyurethane resins and polyurethane foams, the liquids will harden in as little as 15 seconds. Therefore, the shape of the cavity reduces turbulence so that these small amounts of liquids don't harden and clog the openings 118, 120. In the preferred embodiment, the side walls 130 are tubular as shown. The overall shape of the cavity will be shown in FIG. 5 and FIG. 6.

Figure 5:
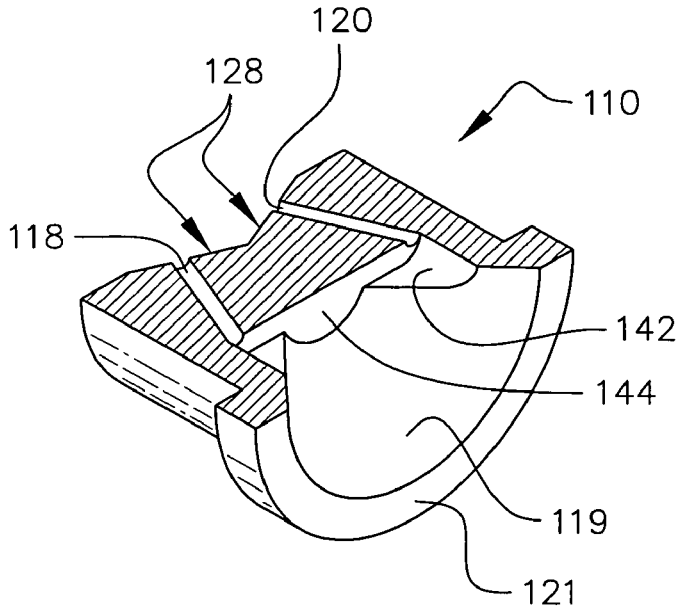
FIG. 5 illustrates a sectional view along lines 5-5 of FIG. 4.

Referring to FIG. 5, a sectional view along lines 5-5 of FIG. 4 is shown. In this sectional view, the openings 118, 120 of the nozzle 110 are bisected, showing the angular relationship between each other. In this embodiment, the face of the nozzle 128 is shown cut in a convex shape. In other embodiments, the face 128 is flat or shaped (not shown). In some embodiments, more than one pair of openings 118, 120 is present (not shown). The inside cavity (conical shape) 119 is formed between the back edge 121 of the nozzle and a flat surface 144 behind the face 128 of the nozzle. Cuts 142 made into the cone 119 create a passage through which the liquid can flow to the openings 118, 120. In the preferred embodiment, the cuts 142 are rounded in shape to further reduce turbulence. The cone 119 and the cuts 142 reduce turbulence by providing a smooth transition from the spray gun (not shown) to the openings 118, 120, thereby reducing or eliminating dead spots and turbulence. The improvements of the present invention reduce Volatile Organic Compound (VOC) emissions during the application of resins.

Figure 6:
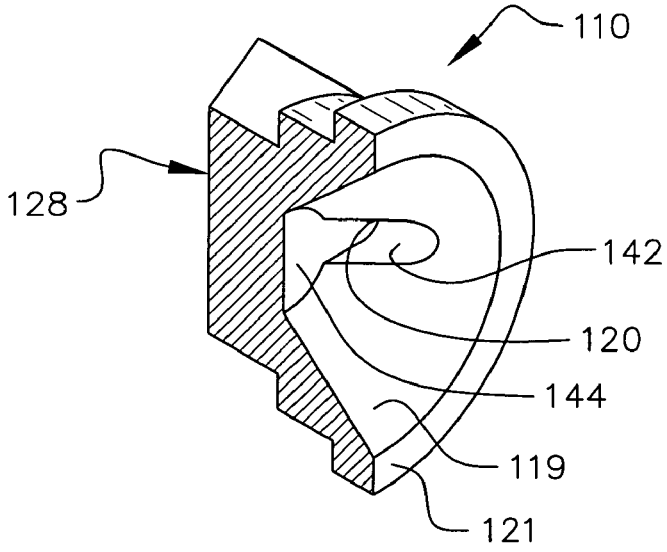
FIG. 6 illustrates a sectional view along lines 6-6 of FIG. 4.

Referring to FIG. 6, a sectional view along lines 6-6 of FIG. 4 is shown. In this sectional view, only one opening 120 is visible, passing from the cavity to the face 128. In this embodiment, the face of the nozzle 128 is shown cut in a convex shape. In other embodiments, the face 128 is flat or shaped (not shown). In some embodiments, more than one pair of openings 118, 120 is present (not shown). The cone 119 is formed between the back edge 121 of the nozzle 110 and a flat surface 144 of the nozzle 110. Cuts 142 are formed into the cone 119 creating a passage through which the liquid can flow to the openings 118, 120. In the preferred embodiment, the cuts 142 are rounded in shape to further reduce turbulence. The cone 119 and the cuts 142 reduce turbulence by providing a smooth transition from the spray gun (not shown) to the openings 118, 120, thereby reducing or eliminating dead spots and turbulence. The improvements of the present invention reduce Volatile Organic Compound (VOC) emissions during the application of resins.

Figure 7:
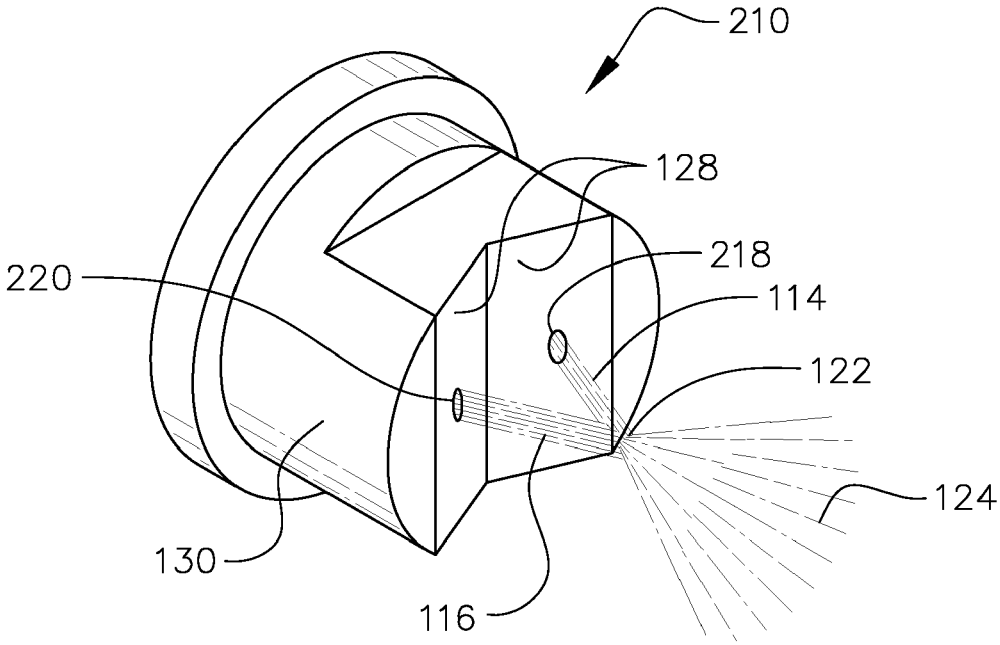
FIG. 7 illustrates a front perspective view of the nozzle and spray pattern of a second embodiment of the present invention.

Referring to FIG. 7, a front perspective view of the nozzle and spray pattern of the present invention is shown. The nozzle 210 of the present invention shown in FIG. 7 is affixed to a spray gun (not shown) which has a pressurized source (also not shown) such as a pump that directs liquid through the nozzle 210 openings 218 and 220. The openings 218 and 220 are spaced apart at a distance and angled towards each other such that liquid 114 flowing from the first opening 218 meets the liquid 116 flowing from the second opening 220 at an apex 122 distal from the face 128 of the nozzle 210. In some embodiments, the liquids flowing from the first opening 218 and from the second opening 220 are the same while in other embodiments, a different liquid flows from the second opening 220. In some embodiments, more than one pair of openings is deployed (not shown). In some embodiments, the face 128 is flat (not shown) while in some embodiments, the face 128 is shaped or etched.

The liquid streams 114/116 flow from the openings 218/220 at an angle towards one another such that they meet at an apex 122 and form a triangular spray pattern 124 beyond the apex 122. The angle of the between openings 218/220 can range anywhere between 1° and 89°. The smaller the degree of angle with respect to the face 128, the closer the two streams meet at the apex 122. It is preferred for use in the spray of resin to have the angle of the openings 218/220 range between 2° and 55°. In some embodiments, the openings 218/220 are circular as shown. In other embodiments, the openings 218/220 are oval or any other shape (not shown). Generally, in non-circular configurations, the opening size can be from 0.00002 to 3.5 square inches. In the preferred embodiment, the openings 218/220 are circular with a diameter in the range of 0.005 to 0.175 inches. In one embodiment, the distance between the openings can be from 0.01 to 2.0 inches. In agricultural and water nozzles, the angle of the openings 218/220 is preferred to be between 5° and 75° with a circular opening diameter between 0.01 to 0.2 inches with a distance between openings 118/120 of between 0.1 and 16 inches. In the preferred embodiment, the side surface 130 is generally rounded.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form hereinbefore described being merely an exemplary and explanatory embodiment thereof. It is the intention of the following claims to encompass and include such changes.

What is claimed is:

1. A nozzle for spraying a liquid, the nozzle comprising:

two openings in a face adapted for generating a non-atomized liquid stream of the same liquid from each of the two openings, the two openings comprising a first opening and a second opening;

the first opening spaced apart from the second opening;

the first opening and the second opening angled along a common axis towards each other at an angle between 1° and 89°;

the nozzle adapted to receive the non-atomized liquid stream of the same liquid directed through the two openings by a pressurized source;

an inside cavity substantially conical in shape, the inside cavity extending from the first and second openings to a back surface of the nozzle; and the two openings configured so the non-atomized liquid stream of the same liquid from the first opening meets the non-atomized liquid stream of the same liquid from the second opening at an apex located a distance from the common axis without interference from any solid object interposed between the common axis and the apex, the meeting of the non-atomized liquid streams of the same liquid creating a triangular liquid spray pattern.

2. The nozzle according to claim 1, wherein each opening of the two openings is circular in shape.

3. The nozzle according to claim 2, wherein each opening of the two openings has a diameter of from 0.005 to 0.175 inches.

4. The nozzle according to claim 1, wherein each opening of the two openings has an area of from 0.00002 to 3.5 square inches.

5. The nozzle according to claim 1, wherein the distance between the first opening and the second opening is from 0.010 to 2.0 inches.

6. The nozzle according to claim 1, wherein the distance between the first opening and the second opening is from 0.1 to 16 inches.

7. The nozzle according to claim 1, wherein the first opening is angled toward the second opening between 2° and 55°.

8. A nozzle for spraying a liquid, the nozzle comprising:

two openings passing through a face of the nozzle, the two openings comprising a first opening and a second opening;

the first opening spaced apart from the second opening by from 0.010 to 2.0 inches;

the first opening and the second opening angled along a common axis towards each other at an angle between 1° and 89°;

the nozzle adapted for generating a non-atomized liquid stream of the same liquid, the non-atomized liquid stream of the same liquid directed through the two openings by a pressurized source;

an inside cavity substantially conical in shape, the inside cavity extending from the first and second openings to a back surface of the nozzle; and the two openings configured so the non-atomized liquid stream of the same liquid from the first opening meets the non-atomized liquid stream of the same liquid from the second opening an apex distal from the common axis without interference from any solid object interposed between the common axis and the apex, the meeting of the non-atomized liquid streams of the same liquid creating a triangular liquid spray pattern.

9. The nozzle according to claim 8, wherein each opening of the two openings is circular in shape.

10. The nozzle according to claim 9, wherein each opening of the two openings has a diameter of from 0.005 to 0.175 inches.

11. The nozzle according to claim 8, wherein each opening of the two openings has an area of from 0.00002 to 3.5 square inches.

12. The nozzle according to claim 8, wherein the first opening is angled toward the second opening between 2° and 55°.

13. A nozzle for spraying a liquid, the nozzle comprising:

a device for mounting two circular openings on a fixed support along a common axis, the two circular openings comprising a first circular opening and a second circular opening;

the first circular opening spaced apart from the second circular opening;

the first circular opening and the second circular opening angled along the common axis towards each other at an angle between 1° and 89°;

the nozzle adapted to receive a non-atomized liquid stream of the same liquid directed through each of the two circular openings by a pressurized source;

an inside cavity substantially conical in shape, the inside cavity extending from the first and second openings to a back surface of the nozzle; and the two circular openings configured so the non-atomized liquid stream of the same liquid from the first circular opening meets the non-atomized liquid stream of the same liquid from the second circular opening at an apex distal from the common axis without interference from any solid object interposed between the common axis and the apex, the meeting of the non-atomized liquid streams of the same liquid creating a triangular liquid spray pattern.

14. The nozzle according to claim 13, wherein each circular opening of the two circular openings has a diameter of from 0.005 to 0.175 inches.

15. The nozzle according to claim 13, wherein the distance between the first circular opening and the second circular opening is from 0.01 to 2.0 inches.

16. The nozzle according to claim 13, wherein the distance between the first circular opening and the second circular opening is from 0.1 to 16 inches.

17. The nozzle according to claim 13, wherein the first circular opening is angled toward the second circular opening between 2° and 55°.

18. An improved nozzle for spraying a liquid of the type which has, at least one pair of openings in a face of the nozzle adapted for generating an uninterrupted non-atomized solid liquid stream of the same liquid from the at least one pair of openings directed towards each other;

each opening from each pair of openings being spaced apart from each other and angled along a common axis towards each other at an angle between 1° and 89°;

the nozzle adapted to receive the uninterrupted non-atomized solid liquid stream of the same liquid directed through each opening by a pressurized source; and the openings configured so the uninterrupted non-atomized solid liquid stream of the same liquid from each opening meet at a distance from the common axis without interference from any solid object interposed between the common axis and the meeting of the uninterrupted non-atomized solid liquid stream of the same liquid, the meeting of the uninterrupted non-atomized solid liquid stream of the same liquid creating a triangular liquid spray pattern;

wherein the improvement comprises:

a conical shaped cavity within the nozzle behind the face the conical shaped cavity extending from the at least one pair of openings to a back surface of the nozzle.

19. The improved nozzle according to claim 18, wherein each opening of the at least one pair of openings is circular in shape.

20. The improved nozzle according to claim 19, wherein each opening of the at least one pair of openings has a diameter of from 0.005 to 0.175 inches.

21. The improved nozzle according to claim 18, wherein each opening of the at least one pair of openings has an area of from 0.00002 to 3.5 square inches.

22. The improved nozzle according to claim 18, wherein the distance between each opening of the at least one pair of openings is from 0.01 to 2.0 inches.

23. The improved nozzle according to claim 18, wherein the distance between each opening of the at least one pair of openings is from 0.1 to 16 inches.

24. The improved nozzle according to claim 18, wherein each opening of the at least one pair of openings are angle along a common axis toward each other between 2° and 55°.

25. The improved nozzle according to claim 18, wherein the conical shaped cavity is cut deep enough to connect the openings with the cavity.

26. The improved nozzle according to claim 25, wherein the cut is rounded and smooth.

* * * * *